US005774861A

United States Patent [19]

Spector

[11] Patent Number: 5,774,861

[45] Date of Patent: Jun. 30, 1998

[54] MIRROR AND LIGHT BOX ASSEMBLY WITH MOTHER'S IMAGE DISPLAY AND VOICE PLAYBACK ACTIVATED BY CRYING INFANT

[76] Inventor: Donald Spector, 380 Mountain Rd., Union City, N.J. 07080

[21] Appl. No.: 785,815

[22] Filed: Jan. 9, 1997

[51] Int. Cl.[6] ..... G10L 9/06; G09F 27/00

[52] U.S. Cl. ..... 704/275; 381/110; 40/455; 369/19

[58] Field of Search ..... 704/270, 272, 704/275; 381/110; 40/455; 369/19

[56] References Cited

U.S. PATENT DOCUMENTS

| | | | |
|---|---|---|---|
| 4,640,034 | 2/1987 | Zisholtz | 40/455 |
| 4,640,267 | 2/1987 | Lawson | 128/898 |
| 5,356,287 | 10/1994 | McIntyre | 434/320 |
| 5,452,274 | 9/1995 | Thompson | 369/19 |

*Primary Examiner*—David R. Hudspeth
*Assistant Examiner*—Tālivaldis Ivars Šmits
*Attorney, Agent, or Firm*—Michael Ebert

[57] ABSTRACT

A mirror and light box assembly installable in a crib or other enclosure occupied by an infant. The assembly which is interactive with the infant includes a light box on whose front face is mounted a semi-reflective mirror behind which is a film transparency having a photographic image of the infant's mother. When an electric light bulb in the box is energized to illuminate the transparency, the image of the mother becomes visible to the infant through the then effectively transparent mirror. Associated with the light box is a sound-activated switching device connected between the bulb and a power source. The switching device, when activated by crying sounds emanating from the infant, remains activated for a predetermined period to energize the bulb and illuminate the transparency. Also associated with the light box is a record playback unit having stored therein a voice message recorded by the mother addressed to her infant, the unit being rendered operative only when the bulb is energized. Hence when the infant cries, it is then presented with an image of its mother as it hears her comforting message, as a consequence of which the infant is induced to stop crying.

11 Claims, 2 Drawing Sheets

MIRROR AND LIGHT BOX ASSEMBLY WITH MOTHER'S IMAGE DISPLAY AND VOICE PLAYBACK ACTIVATED BY CRYING INFANT

BACKGROUND OF INVENTION

1. Field of Invention

This invention relates generally to a mirror and light box assembly in which a light bulb within the box serves to illuminate a film transparency placed behind a semi-reflective mirror mounted on the face of the box whereby the transparency image is visible only when the bulb is energized, and more particularly to an assembly of this type which is installable in an enclosure occupied by an infant and is interactive with the infant.

2. Status of Prior Art

It is known in the toy field to provide a "Magic Mirror" in which placed behind a semi-reflective mirror is light box covered by a film transparency. When an electric light bulb within the box is turned on to illuminate the transparency, a child looking at the mirror then does not see his own reflection, but the illuminated image, for the mirror is then effectively transparent.

Also included in a Magic Mirror toy is a sound unit which when the bulb on the light box is turned on, then reproduces recorded sounds appropriate to the image being presented. Thus if the image is that of a dog, the reproduced sounds would be that of a dog barking.

Essential to a Magic Mirror and to an assembly in accordance with the invention in a mirror which in one mode of operation is effectively transparent and in another is effectively reflective. For this purpose the mirror must be a semi-reflective mirror.

A conventional plane mirror is fabricated by evaporating a metallic film on the rear surface of a transparent plate made of glass or acrylic plastic material. In most mirrors, the reflecting film is aluminum which is deposited on a substrate by evaporation in vacuum. The advantage of aluminum is that it has a broad spectral band of high reflectivity. Almost all aluminum-coated mirrors are "overcoated" with a thin protective layer, such as a layer of magnesium fluoride.

While a conventional aluminum-coated mirror has an average reflectivity of close to 90 percent, mirrors are known whose coating imparts semi-reflective characteristics thereto. Thus a beam impinging on a semi-reflective mirror is split into two parts, one being transmitted through the mirror, the other being reflected thereby.

If therefore the face of a light box is covered by a semi-reflective mirror behind which is a film transparency, then when the box is dark, an observer looking into the mirror sees his own reflection. But if the box interior is illuminated, the observer then sees the image of the transparency, for the mirror is then operating in a light transmitting mode.

The concern of the present invention is with a light box and mirror assembly that is installable in a crib or other enclosure occupied by an infant, the assembly being interactive with the infant in a manner to be later explained.

The most difficult aspect of infancy from a mother's standpoint lies in the sleep habits of her infant. Whether an infant lying in a crib or other enclosure is able to sleep soundly depends on two factors, one being physical and the other psychological. The physical factor turns mainly on whether the infant is hungry or in pain, for in either case the infant will be unable to sleep and will cry out to attract its mother's attention. But many infants who are not disturbed physically, are unable to sleep soundly because they are in a state of anxiety in regard to their mother's whereabouts.

An infant's existence centers on its mother, and a sense of security in regard to its mother is therefore essential to the infant's proper psychological equilibrium. All infant's, however well cared for, remain anxious as to their mother's whereabouts. This insecurity does not vanish in later years, for many pre-school children carry security blankets to reduce anxiety.

The crib in which an infant lies is usually placed in the mother's bedroom or in a nursery adjacent this bedroom so that should the infant cry out, the mother will be aroused from sleep and attend to her baby. But whether in the course of a night the mother is awakened by her infant because the infant is physically uncomfortable or in a state of anxiety, in either event, the mother's sleep is interrupted. A mother's loss of sleep is perhaps the most exhausting aspect of raising an infant.

SUMMARY OF INVENTION

In view of the foregoing, the main object of this invention is to provide a mirror and light box assembly installable in a crib or other enclosure occupied by an infant, which assembly is interactive with the infant.

More particularly, an object of this invention is to provide an assembly of the above type which reacts to an infant's cries to present the infant with an image of its mother accompanied by her voice message, thereby assuring the infant of its mother's attention.

A significant feature of the invention is that the assembly is customized for the particular infant to be comforted, for the image displayed by the assembly to the infant is that of his actual mother and the voice message it hears comes from the same mother. Hence the assembly functions as a virtual or surrogate mother.

Also an object of the invention is to provide an assembly in which stored in a record playback unit are several different voice messages recorded by the mother of the infant, so that when the assembly is activated, the message then yielded by the unit is different from that previously produced.

Briefly stated, these objects are attained by a mirror and light box assembly installable in a crib or other enclosure occupied by an infant. The assembly which is interactive with the infant includes a light box on whose front face is mounted a semi-reflective mirror behind which is a film transparency having a photographic image of the infant's mother. When an electric light bulb in the box is energized to illuminate the transparency, the image of the mother becomes visible to the infant through the then effectively transparent mirror.

Associated with the light box is a sound activated switching device connected between the bulb and a power source. The switching device, when activated by crying sounds emanating from the infant, remains activated for a predetermined period to energize the bulb and illuminate the transparency. Also associated with the light box is a record play back unit having stored therein a voice message recorded by the mother addressed to her infant, the unit being rendered operative only when the bulb is energized. Hence when the infant cries, it is then presented with an image of its mother as it hears her comforting message, as a consequence of which the infant is induced to stop crying.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

Figure 1:
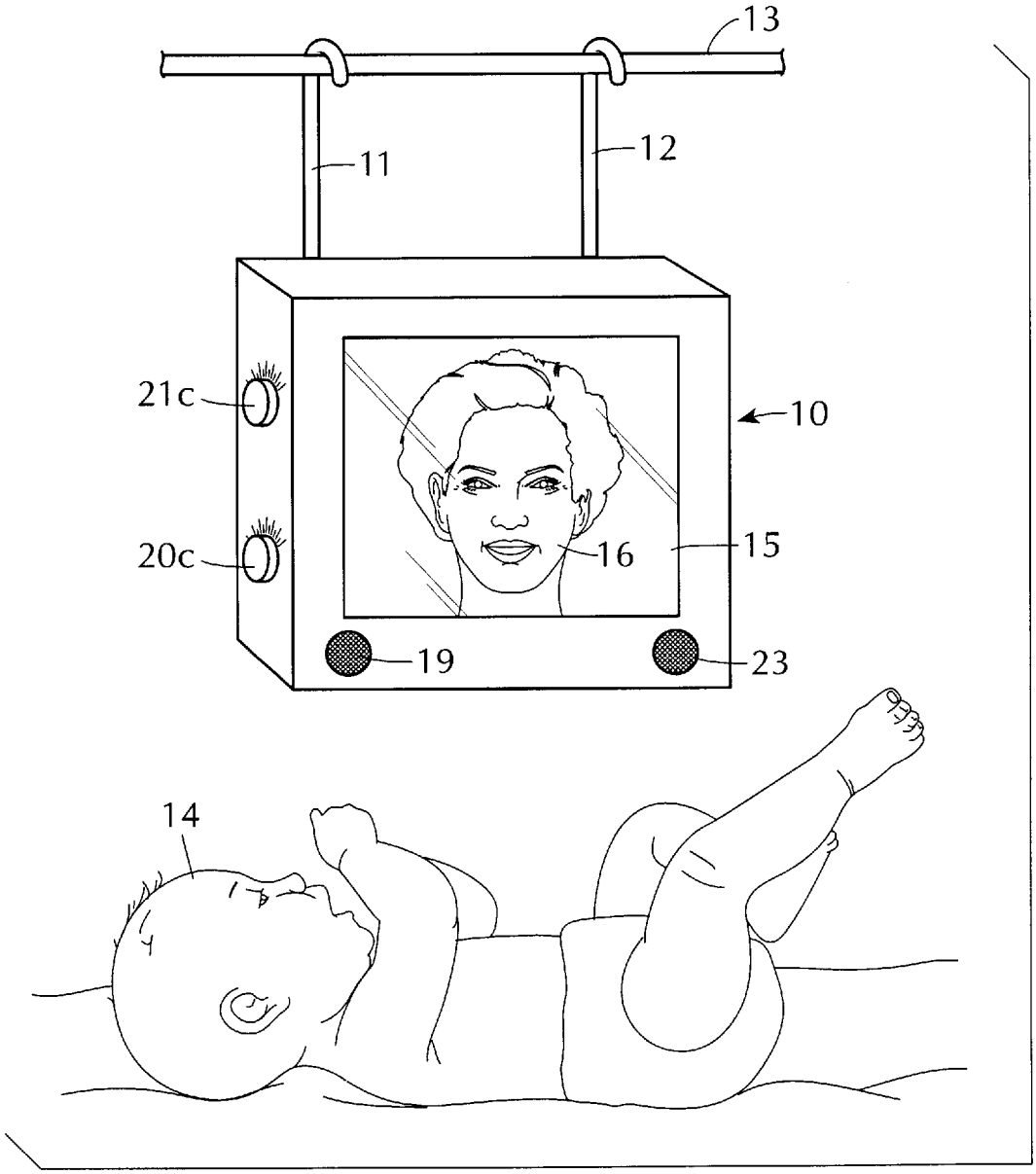
FIG. 1 shows a light box and mirror assembly in accordance with the invention installed in a crib occupied by an infant.
Figure 2:
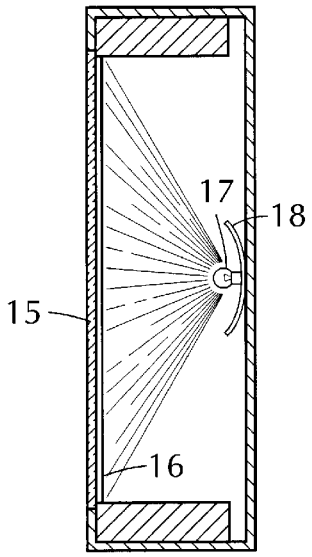
FIG. 2 is a section taken through the assembly.
Figure 3:
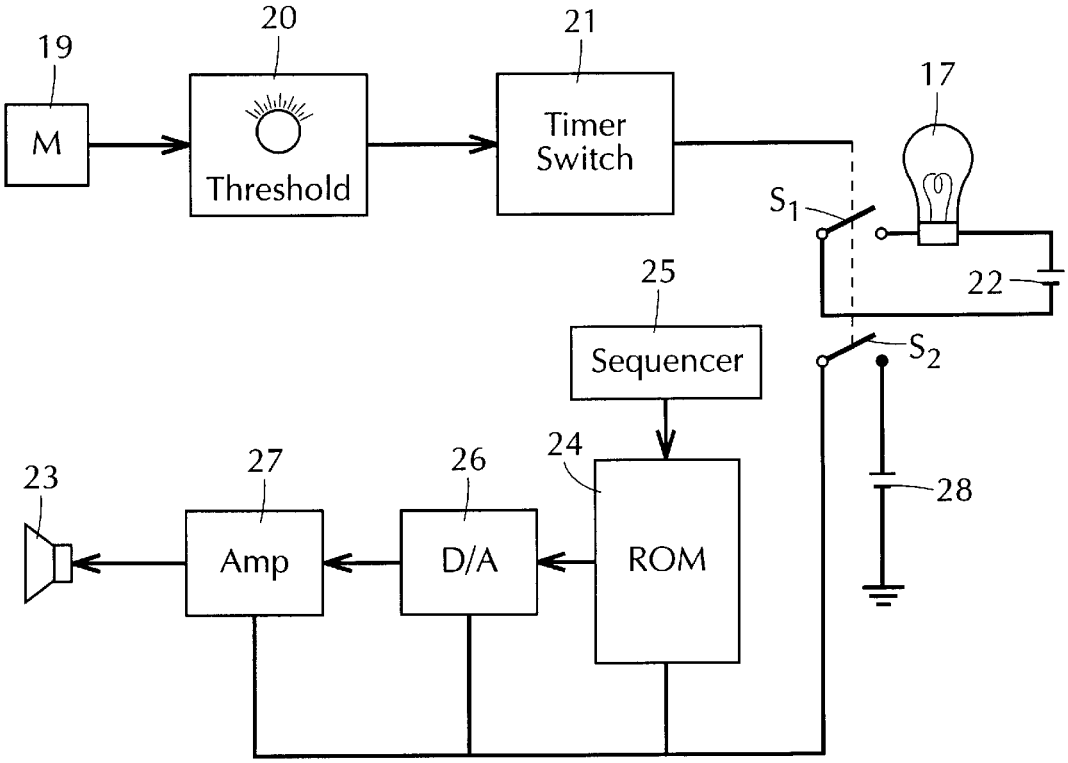
FIG. 3 is a block diagram of the sound-activated switching device and the record playback unit included in the assembly.

Referring now to FIGS. 1 and 2, there is shown a light box and mirror assembly in accordance with the invention, generally identified by reference numeral 10. The assembly is provided with a pair of hooks 11 and 12 so that it can be suspended from a rail 13 or other horizontal structure on a crib or enclosure at a position where it can be seen by an infant 14 lying in the crib. In practice, the assembly exterior may be padded so as not to cause injury should the infant make physical contact therewith.

Mounted on the front face of the generally rectangular box 10 is a semi-reflective planar mirror 15. This mirror is preferably formed of a non-shatterable transparent acrylic plastic plate having a coating on its rear surface that renders the mirror semi-reflective.

Placed behind mirror 15 is a rectangular film transparency 16 containing a photographic image of the head of the mother of the infant for which the assembly is intended. The head of the mother is preferably in full scale so that when seen by the infant, the infant is under the impression that it is seeing its actual mother.

Mounted at the rear of box 10 is an electric light bulb 17 which is placed within a concave reflector 18 so that the rays radiating from the bulb are directed toward transparency 16. The bulb is preferably a low-voltage bulb so that it may be battery operated whereby the assembly is self-contained and need not be plugged into a power outlet. However, to obtain a greater light output, a high voltage electric bulb may be used. And to obtain uniform illumination of the transparency, a light diffusion plate may be placed behind the transparency.

When the light bulb is turned off, the box interior is dark and the semi-reflective mirror 16 then operates in a reflecting mode, for light impinging on its outer surface is reflected thereby. Hence should infant 14 then look into the mirror, the infant will see its own reflection. But when light bulb 17 is turned on, the light radiated by the bulb illuminates transparency 16 and what the infant then sees through the mirror then in a light transmitting mode, is the image of its own mother.

The arrangement is such that the assembly is activated only when the infant cries loudly, for should the infant just whimper or sob lightly, there is no need to then activate the assembly. To this end, associated with the assembly is a sound-activated switching device that includes a microphone 19 placed in the front of box 10 adjacent its left side below mirror 15, to pick up sounds emanating from infant 14. The output of microphone 19 is connected through an adjustable threshold device 20 to an adjustable timer switch 21 which when operative, simultaneously closes switches $S_1$ and $S_2$.

Threshold device 20 is an adjustable bias circuit that is set by the user of the assembly to activate timer switch 21 only when the sounds of the infant's crying as picked up by microphone 19 exceeds in amplitude a predetermined threshold level. Control knob 20C for threshold device 20 is on the side of the box, so that the user can set the threshold to a level appropriate to the infant, for some infant's are capable of crying much more loudly than others. For an infant whose loudest cries are of relatively low amplitude, the threshold setting should be such as to activate the assembly when the amplitude of the cries is relatively low. For any given infant, the threshold setting must be such as to activate the assembly when the cries are loud for that infant, and to not activate the assembly when for that infant, the cries are relatively soft.

The timing period of timer switch 21 is adjustable by a control 21C which is also on the side of the box so that the user can adjust the time duration to a period appropriate to the infant, say in a range of about 1 to 5 minutes. The duration during which the infant is presented with an image of its mother should be long enough to relieve the infant's anxiety as to the whereabouts of its mother. However, if at the end of the timed period, the infant is still crying, the timer switch 21 will be reactivated by these crying sounds.

When timer switch 21 is activated by the sounds of the infant to close switch $S_1$, this switch then connects light bulb 17 to a battery 22 or whatever other power source is used to energize the bulb. In practice instead of an incandescent bulb, use may be made of a batter-operated fluorescent bulb which for a given wattage produces a greater light output than an incandescent bulb of the same wattage.

Timer switch 21 closes switch $S_2$ at the same time it closes switch $S_1$. Switch $S_2$, when closed, activates a record play back unit associated with the assembly. The unit includes a miniature loud speaker 23 mounted on the front face of box 10 below the mirror on the right side.

The record playback unit has digitally stored in a Read-Only-Memory (ROM) 24 a series of short voice messages recorded by the mother of the infant. Hence the assembly must be tailored to whomever acquires the assembly, for the assembly must include a photographic transparency of the mother and a recording of her voice. The mother's message is intended to comfort her infant and preferably therefore should be a message which is already familiar to the infant from past experience. Thus one message could be "hush-a-bye baby, go to sleep," another could be "Go to sleep, Go to sleep, Baby Go-to-Sleep" and still another "it will be all right my baby, my baby it will be all right." The series of messages formulated by the mother are those she believes will be comforting to her baby.

Coupled to ROM 24 is a sequencer 25 which each time switch $S_2$ closes, then acts to read out from ROM 24 the next one in the series of recorded voice messages. Thus if stored in the ROM are five brief voice messages and the previous message read out was number five in the series, sequencer 23, when switch $S_2$ closes, will read out message number one. Thus the same message is not repeated when the sound play back unit is activated, and the infant hears a message that is different from the one he heard before. It is important that the infant not gain the impression of a robot mother which would be the case where every time the infant cried he heard the same message from his mother.

The message read out of ROM 24 is converted into an analog signal by a digital-to-analog converter 26. This analog signal is amplified in an amplifier 27 whose output is applied to loudspeaker 23. All stages of the record play back unit can be integrated into a solid state circuit chip except for microphone 19. This unit is powered by battery 28.

Thus when the infant in the crib cries loudly, then simultaneously activated for a predetermined period is the lighting system which illuminates the transparency image of the infant's mother and the record playback unit which yields the voice message of the mother. This audio-visual presentation assures the infant of its mother's concern and relieves the infant of whatever anxiety is disturbing its sleep. But the assembly is not limited in its utility to a sleeping infant, for if the baby cries while awake, the assembly will be activated to comfort the child.

While there has been shown a preferred embodiment of an assembly in accordance with the invention, it will be appreciated that many changes and modifications may be made therein without, however, departing from the essential spirit thereof. Thus if the infant is being taken care of not by its mother, but by a nanny or nurse, then the transparency will show that of the nanny or nurse, and the recorded voice will be of the same individual.

I claim:

1. A mirror and light box assembly installable in an enclosure occupied by an infant having a mother, said assembly comprising:

A. a light box having a front face on which is mounted a semi-reflecting mirror behind which is a film transparency which is a photographic image of the mother;

B. a light producing means within the box which when activated then illuminates the transparency to render the image visible to the infant through the mirror which is then effectively transparent;

C. a record playback unit associated with the box which when activated, reproduces a voice message recorded by the mother addressed to her infant; and D. means responsive to sounds of crying emanating from the infant to concurrently activate the light producing means and the playback unit whereby when the infant cries, it is then presented with and comforted by an image of its mother and her voice message.

2. An assembly as set forth in claim 1, in which the enclosure is a crib, and the assembly is provided with means to suspend the box from a rail in said crib.

3. An assembly as set forth in claim 1, in which said light-producing means includes a light bulb and a power source therefor.

4. An assembly as set forth in claim 3, in which said light-producing means is actuated by a sound-activated switching device connected between said bulb and said power source.

5. An assembly as set forth in claim 4, in which said switching device includes a microphone which picks up the cries of the infant to produce a signal which activates a timer switch to connect said bulb to the power source for a predetermined time period.

6. An assembly as set forth in claim 5, further including a threshold device interposed between the microphone and the timer switch to cause said signal to activate the timer only when the amplitude of the infant's cries exceed a predetermined threshold level.

7. An assembly as set forth in claim 6, in which the threshold device includes setting means to adjust the threshold level.

8. An assembly as set forth in claim 5, in which the timer switch includes setting means to adjust said time period.

9. An assembly as set forth in claim 1, in which said record playback unit includes a read-only memory in which said voice message is stored, and means to read out the message and convert it into an analog signal which is then reproduced.

10. An assembly as set forth in claim 9, in which said read-only-memory stores a series of different voice messages and a sequencer coupled to said memory to read out the next message when the playback unit is activated.

11. An assembly as set forth in claim 9 in which the signal is reproduced by a loud speaker mounted below the mirror on the face of the box.

* * * * *